US008703254B2

(12) United States Patent
Kinderman

(10) Patent No.: US 8,703,254 B2
(45) Date of Patent: Apr. 22, 2014

(54) ADAPTABLE THREE-DIMENSIONAL ORNAMENTAL WIRE FRAME MODEL

(75) Inventor: Israel Richard Kinderman, Gladwyne, PA (US)

(73) Assignee: J. Kinderman & Sons, Inc., Philadelphia, PA (US)

( * ) Notice: Subject to any disclaimer, the term of this patent is extended or adjusted under 35 U.S.C. 154(b) by 585 days.

(21) Appl. No.: 12/975,082

(22) Filed: Dec. 21, 2010

(65) Prior Publication Data

US 2011/0151147 A1 Jun. 23, 2011

Related U.S. Application Data

(60) Provisional application No. 61/288,667, filed on Dec. 21, 2009.

(51) Int. Cl.
*G09F 19/08* (2006.01)

(52) U.S. Cl.
USPC ..... 428/16; 40/411; 40/415; 40/418

(58) Field of Classification Search
USPC ..... 428/9, 16; 40/411, 415, 418
See application file for complete search history.

(56) References Cited

U.S. PATENT DOCUMENTS

| | | | | |
|---|---|---|---|---|
| 3,555,722 | A | 1/1971 | McLain et al. | |
| 5,451,436 | A | 9/1995 | Shelleman | |
| 5,766,701 | A | 6/1998 | Lee | |
| 5,784,815 | A | 7/1998 | Hermanson | |
| 5,850,927 | A | 12/1998 | Pan | |
| 5,955,156 | A | 9/1999 | Hermanson | |
| 6,180,193 | B1 | 1/2001 | Bostedt | |
| 6,394,282 | B1 | 5/2002 | Pan | |
| 6,413,594 | B1 | 7/2002 | Onishi | |
| 6,478,164 | B1 | 11/2002 | Pan | |
| 6,758,001 | B1 | 7/2004 | Su | |
| 6,769,954 | B2 | 8/2004 | Su | |
| 6,901,693 | B1 | 6/2005 | Crowe | |
| 7,325,996 | B2 | 2/2008 | Varner et al. | |
| 7,610,705 | B2 | 11/2009 | Liu | |
| 7,943,211 | B2 * | 5/2011 | Chen | 428/9 |
| 2004/0068903 | A1 | 4/2004 | Chin | |
| 2007/0006495 | A1 * | 1/2007 | Liu | 40/414 |

* cited by examiner

*Primary Examiner* — David Sample
*Assistant Examiner* — Nicholas W Jordan
(74) *Attorney, Agent, or Firm* — Panitch Schwarze Belisario & Nadel LLP

(57) ABSTRACT

An adaptable three-dimensional ornamental wire frame model includes a head, a neck, a body and various appendages. The various appendages are mounted to the body or to each other by pivot joints that permit pivoting of the appendages relative to the body and/or to each other. The model is adaptable to posing in multiple ornamental positions and configurations as desired by the user. Preferably, lights on a light string are mounted on the adaptable three-dimensional ornamental wire frame model to outline the shape of the model.

20 Claims, 16 Drawing Sheets

ADAPTABLE THREE-DIMENSIONAL ORNAMENTAL WIRE FRAME MODEL

CROSS-REFERENCE TO RELATED APPLICATION

This application claims the benefit under 35 U.S.C. §119 (e) of U.S. Provisional Patent Application No. 61/288,667, filed Dec. 21, 2009, the disclosure of which is hereby incorporated herein by reference in its entirety.

BACKGROUND OF THE INVENTION

The present invention generally relates to an adaptable three-dimensional ornamental wire frame model for display by a user in various poses or configurations. A preferred embodiment of the present invention is directed to an adaptable ornamental wire frame deer model for displaying in various poses, where "deer" as used herein includes reindeer. The preferred deer model includes pivot joints at its head, hips and the knees that pivot in a generally anatomically correct manner and lock in various positions such that the user can pose the model.

Three-dimensional ornamental wire frame models are used for decorations, often during the holiday season and typically as yard ornaments or indoor decorations. The wire frame models are often draped with lights on the wires such that the outline of the wire frame is illuminated in the dark, but could also be without lights. These wire frame models are typically provided in two varieties including a fixed position model and a motorized model. The fixed position model has a predetermined display position wherein the legs, body, neck, head and other components of the model are fixed in a specific orientation relative to other components in a fixed display configuration. Although these fixed position models may have detachable or foldable components that are detached or folded for shipping and/or storage purposes, the fixed position models have only the single, fixed display configuration where the components are locked together and the model is limited to being displayed in this fixed configuration. U.S. Pat. Nos. 5,766,601 and 5,850,927 provide examples of such fixed position models. The motorized models include a motor that drives pivoting of the head, neck and/or tail of the model in predetermined motions to give the appearance that the model is moving, thereby creating a more lifelike appearance. U.S. Pat. No. 6,394,282 provides an example of a motorized model. The wire frame models are rigidly mounted in position with the exception of pivoting for the purposes of folding or disassembling of the fixed position model for storage and/or shipping or for movement under the driving forces of the motor of the motorized models.

The fixed position (also referred to herein as "static") and motorized models are limited in their positioning for display purposes, because the models are pre-configured into their display positions by the manufacturer and the user has no ability to pose the ornamental models based upon the user's desire. For example, a common desire among holiday decorators is to recreate a Santa in a sleigh with reindeer scene where the first set of deer appear to be flying, the middle set of deer appear to be "taking off" and the set of deer closest to the sleigh appear to be running. Such a display would require the purchase of several fixed position deer models with different leg positions to replicate the realistic appearance of the deer. In addition, if one of these fixed position deer models is damaged or malfunctions, the specific one of the fixed position deer would have to be ordered to replace the specific damaged model deer. Accordingly, these fixed position models are not adaptable to the user's preferences and may be costly or difficult to replace if damaged.

It is desirable to design and construct an adaptable three-dimensional wire frame ornamental model that permits the user to pose the model in user selected and preferably anatomically correct postures. It is preferable that the adaptable ornamental wire frame model is easily manipulated into various poses without significant tooling or efforts on the part of the user. The preferred embodiment of the present invention satisfies these desires.

BRIEF SUMMARY OF THE INVENTION

One aspect of the present invention is an adaptable three-dimensional ornamental wire frame model for display by a user in various poses or configurations, the model comprising components including: a body; a neck having a body end and a head end, the neck being mountable to the body at the body end of the neck; a head mounted to the head end of the neck; and an appendage mounted to the body; wherein at least one of the head, the neck and the appendage is reconfigurable to a different pose or configuration by the user.

Other aspects of the adaptable model are wherein the appendage optionally includes an upper appendage and a lower appendage, and wherein at least one, at least two, at least three or all of the head, the neck, the upper appendage or the lower appendage is or are reconfigurable to a different pose or configuration by the user.

Yet another aspect of the adaptable model is wherein the appendage is pivotably mounted to the body by a pivot joint.

Still another aspect is wherein the lower appendage is wherein the appendage includes an upper appendage and a lower appendage and the lower appendage is pivotably mounted to the upper appendage by a pivot joint, whether or not the upper appendage is pivotably mounted to or merely connected to or unitarily and integrally formed with the body.

Another aspect of the adaptable model is wherein the head is mounted to the neck by a pivot joint.

A further aspect of the adaptable model is wherein the neck is mounted to the body by a neck joint that is reconfigurable with respect to the body, the head is mounted to the head end of the neck at a head joint that is movable with respect to the neck, the appendage includes an upper appendage pivotably mounted to the body by a first pivot joint and a lower appendage pivotably mounted to the upper appendage by a second pivot joint, the first and second pivot joints including first and second mounts that are pivotable relative to each other, the neck and head joints and the first and second pivot joints permitting the user to display the model in various poses and configurations as desired by the user.

The adaptable model may have a decorative covering over the wire frame. Moreover, the adaptable model, once fixed in a desired position by a user, may be static or animated.

BRIEF DESCRIPTION OF THE DRAWINGS

The foregoing summary, as well as the following detailed description of a preferred embodiment of the invention, will be better understood when read in conjunction with the appended drawings. For the purpose of illustrating the preferred adaptable ornamental wire frame model, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
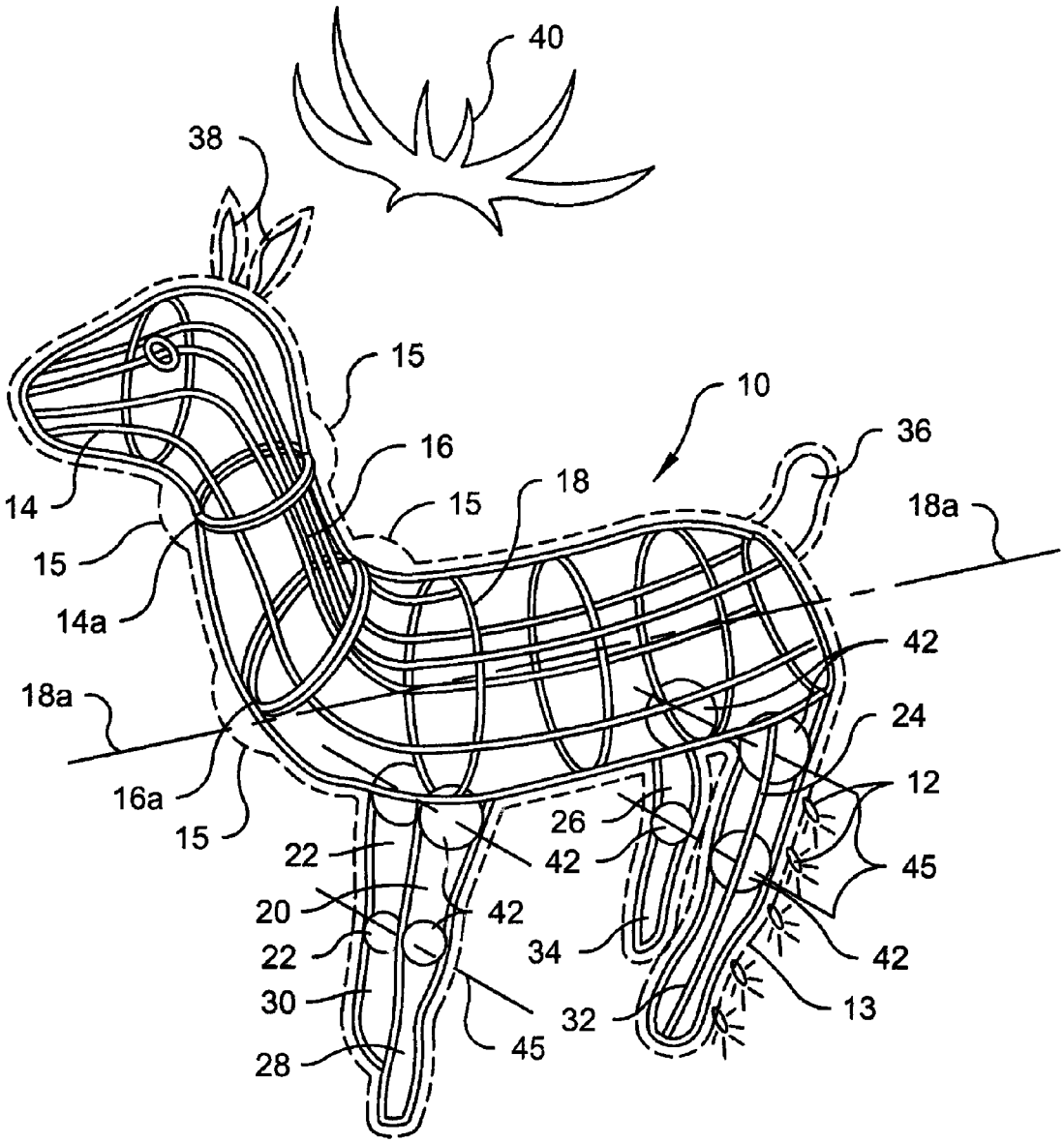
FIG. 1 is a side isometric view of an adaptable ornamental wire frame model in accordance with a preferred embodiment of the present invention.
Figure 2:
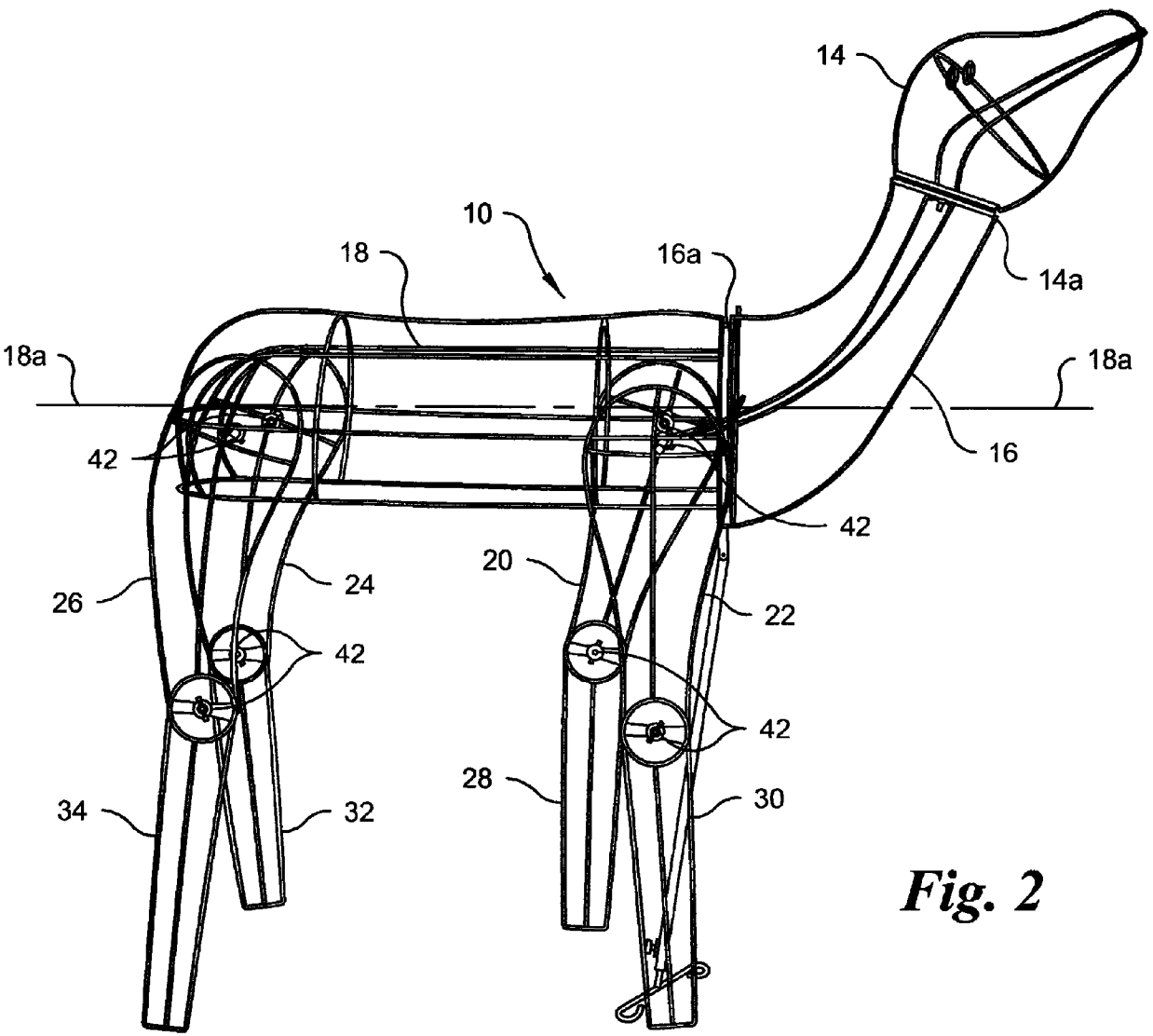
FIG. 2 is a side elevational view of the model of FIG. 1, posed in a standing center configuration.
Figure 3:
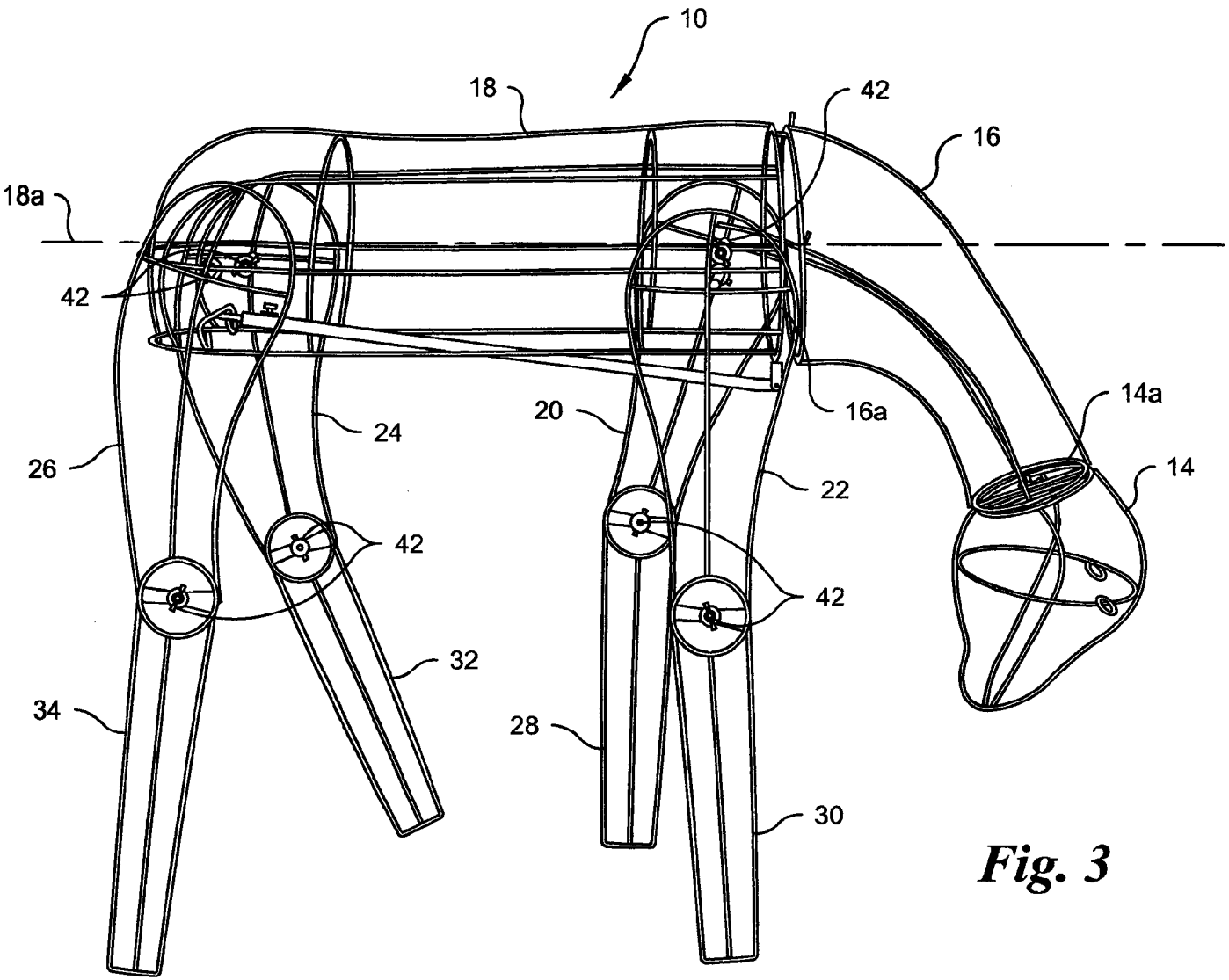
FIG. 3 is a side elevational view of the model of FIG. 1, posed in a standing, feeding center configuration.
Figure 4:
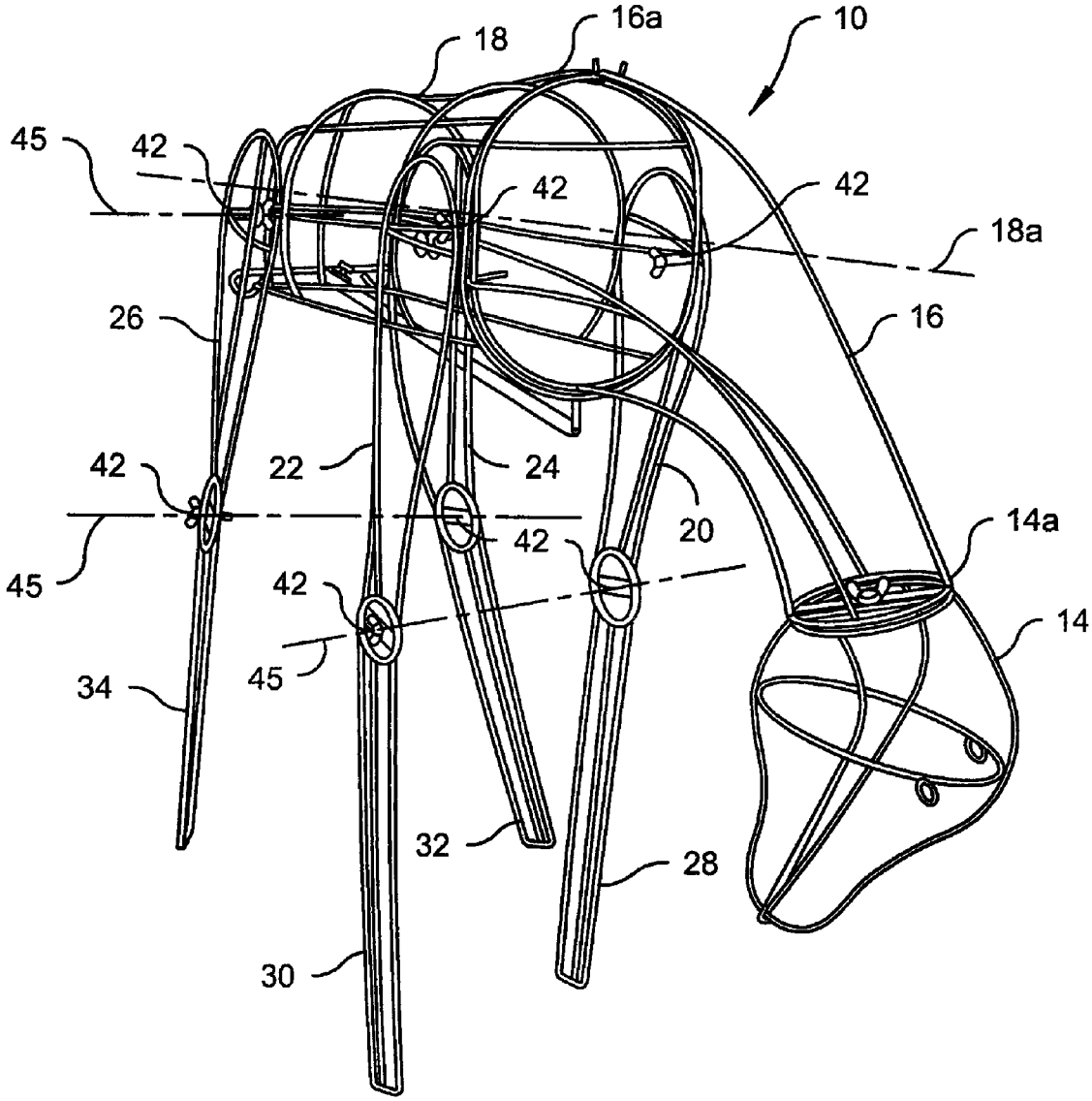
FIG. 4 is a front isometric view of the model of FIG. 1, posed in a standing, feeding left configuration.

Certain terminology is used in the following description for convenience only and is not limiting. The words "right," "left," "lower" and "upper" designate directions in the drawings to which reference is made. The words "inwardly," "outwardly," "distally" or "proximally" refer to directions toward and away from, respectively, the geometric center of the adaptable ornamental wire frame model of the preferred embodiment and positions along the lengths of related parts thereof. The terminology includes the above-listed words, derivatives thereof and words of similar import.

As used herein, the singular forms "a," "an," and "the" include plural referents, and plural forms include the singular referent unless the context clearly dictates otherwise.

Referring to FIGS. 1-7, an adaptable ornamental wire frame model 10 in accordance with a preferred embodiment of the present invention is comprised of several wire frame components that are assembled together and preferably adorned with outdoor lights 12 mounted along a light sting 13, sometimes called a string light, made of electrical wires providing electricity to the lights. The light string 13 is schematically represented by dotted or dashed lines in FIG. 1 and may be wrapped around the various wire frame components or may be clipped to the wire frame components, both in well-known manners. As also shown schematically in FIG. 1, the light string 13 includes slack areas 15 that allow for ready movement and pivoting of the wire frame components into any desired pose or configuration without adversely affecting the light string or preventing appropriate movement or pivoting of the wire frame components.

The wires of the wire frame are preferably constructed of a metal material, such as steel or aluminum that is bent and secured together, generally by welding, to simulate a desired shape. The "wires" may also be made of a polymeric plastic or polymeric material that is sufficiently flexible to be bent, flexed or molded to form a three-dimensional structure, but is sufficiently strong enough to support the weight of the structure and any lights or other adornments attached to the structure. Typical polymeric plastic or polymeric materials may be comprised of, for example, without limitation, polyethylene terephthalate (PET), polyether ether ketone (PEEK), polyvinyl chloride (PVC), polypropylene (PP) or polycarbonate (PC), for example, without limitation. Such plastic material may be molded into any desired shape and adhesively fastened, solvent bonded, heat- or sonically-welded together, or mechanically held together by any suitable fasteners, such as plastic ties, screws, rivets or the like. The wire frame wires may be painted or metal wires coated in plastic or a material that improves the weather resistance of the wire frame wires, if desired. In the preferred embodiment, presented for the sake of clarity of description, the three-dimensional adaptable ornamental wire frame model 10 is shaped in the form of a deer, but is not so limited. For example, the three-dimensional adaptable ornamental wire frame model 10 may be constructed in the form of a snowman, Santa Claus, horse, angel, cow, lamb, dog, moose, witch, penguin, other seasonal animals and various other configurations and shapes that a user may find desirable for ornamental display or seasonal icons used as outdoor décor.

The lights 12, preferably are incandescent and along a rope light or more preferably LED lights in light strings 13 or outdoor string lights 13, and are secured to the wires of the model 10 for illumination and to emphasize the shape of the model 10, particularly in the dark or to generally draw attention to the model 10. The preferred string lights 13 replicate a realistic shape or outline of the decorative model 10 for outdoor display or general display purposes. The preferred string lights 13 of the three-dimensional model 10 provide a whimsical or fantastical appearance that may be desired by users. However, the model 10 is not limited to including lights 12 and may be covered with a fabric material to simulate a desired shape, may include no ornamental covering or may be otherwise draped or decorated to enhance user desired ornamental features.

The preferred three-dimensional wire frame model 10 includes appendages, where the term "appendage" is used herein to describe any body part that is attached to a main body of the model 10, typically limbs, but also including feet, horns, antlers, wings, halos, brooms, hats, arms, legs, tails, ears, noses and other parts or devices attachable to or associated with any desired three-dimensional body structure.

In one preferred embodiment, where the model 10 is configured as a deer, the wire frame components or appendages include a head 14, a neck 16 having a body end attached to a body 18 and a head end attached to the head 14, and four legs each including an upper appendage or leg portion and a lower appendage or leg portion. Thus, as shown in the deer embodiment of FIGS. 1-7, the legs include an upper front left leg portion 20, an upper front right leg portion 22, an upper rear left leg portion 24, an upper rear right leg portion 26, a lower front left leg portion 28, a lower front right leg portion 30, a lower rear left leg portion 32, and a lower rear right leg portion 34. Each of these components is preferably constructed of a metal wire frame that is bent, formed and secured together to form the general size and shape of the component. However, the components are not limited to be constructed of metal wire frame materials and may be constructed of a polymeric, wooden, molded or other variations of components that are able to take on the general size and shape of the components and withstand the normal operating conditions of the components. In addition, the components are not limited to the above-listed components for the deer and may include additional components, such as a tail 36, ears 38, antlers 40 or other components that may be integrally and unitarily formed with portions of the above-listed components, except for components that are movable or pivotable with respect to each other, or may be removably attachable to various of the components. Further, if the model 10 is configured to have an alternate appearance, such as a Santa Claus, dog, horse, snowman, penguin, bear or other animal or object, the components may be broken down, assembled and posed in accordance with a user's preferences, as would be apparent to one having ordinary skill in the art.

The components that are not movable or pivotable with respect to other components are either integrally and unitarily formed with each other or may be removably mounted to each other for breakdown, shipping and storage purposes. In the preferred embodiment of the ornamental deer wire frame model 10, the body 18 is preferably removably mounted to the neck 16, the neck 16 is preferably removably mountable to the head 14 and the ears 38 and antlers 40 are preferably removably mountable to the head 14. In addition, the neck 16 is preferably mountable to the body 18 and the head 14 is preferably adaptably and pivotably mounted to the neck 16 such that the head 14 and neck 16 may be mounted to give the model 10 many user desired different appearances. The head 14 is mounted to the neck 16 at a head joint 14*a* and the neck is mounted to the body 18 at a neck joint 16*a*. The neck 16 is preferably mountable to the body 18 in at least two orientations including a standing orientation (FIG. 2) wherein the neck 16 extends upwardly from the body 18 and a feeding orientation (FIG. 3) wherein the neck 16 extends generally downwardly from the body 18. The neck 16 is not limited to being oriented relative to the body 18 in only the feeding and standing orientations, however, these orientations are preferred for ornamental appearances of the deer model 10.

Figure 5:
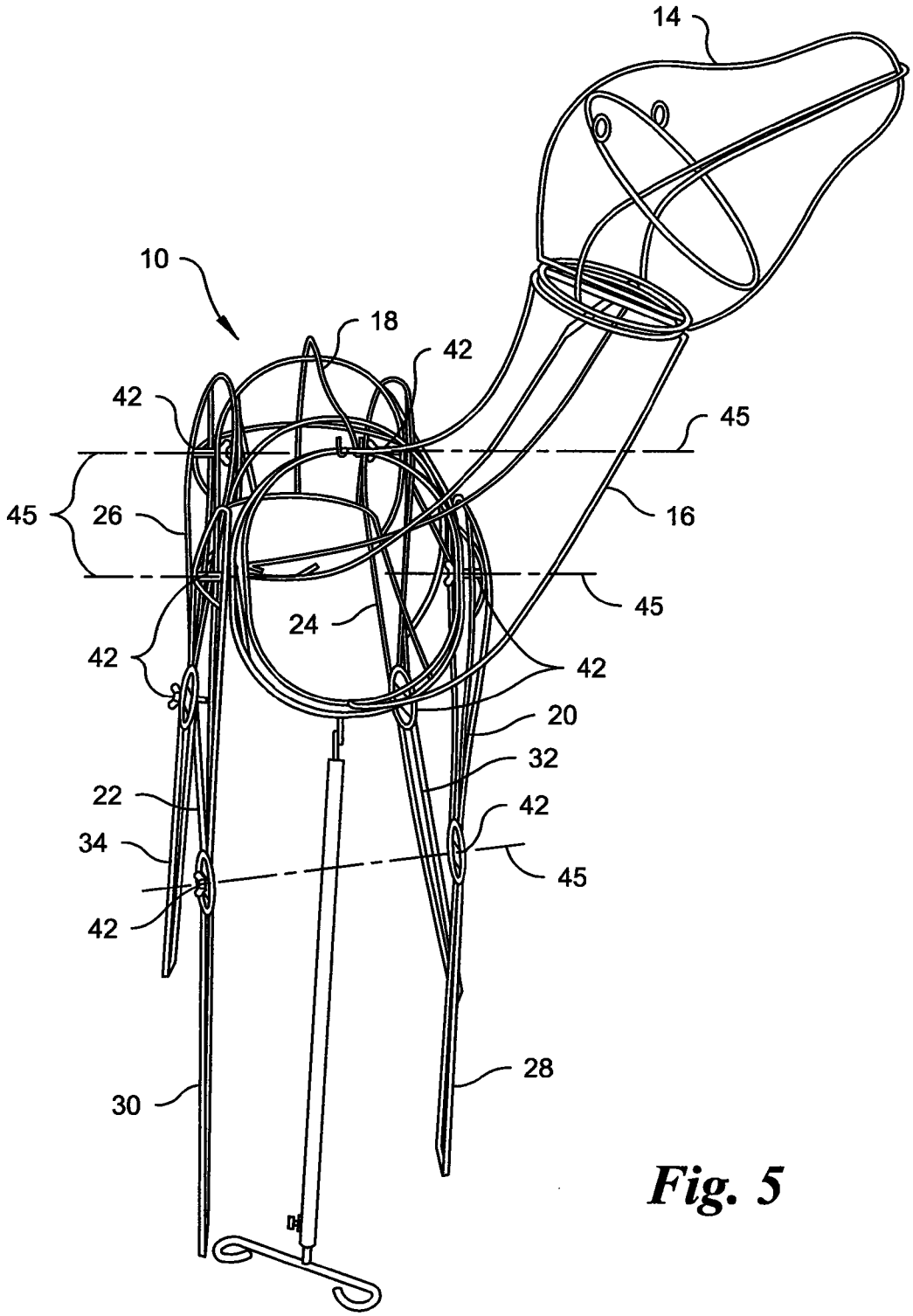
FIG. 5 is an alternate front isometric view of the model of FIG. 1, posed in a standing left configuration.
Figure 6:
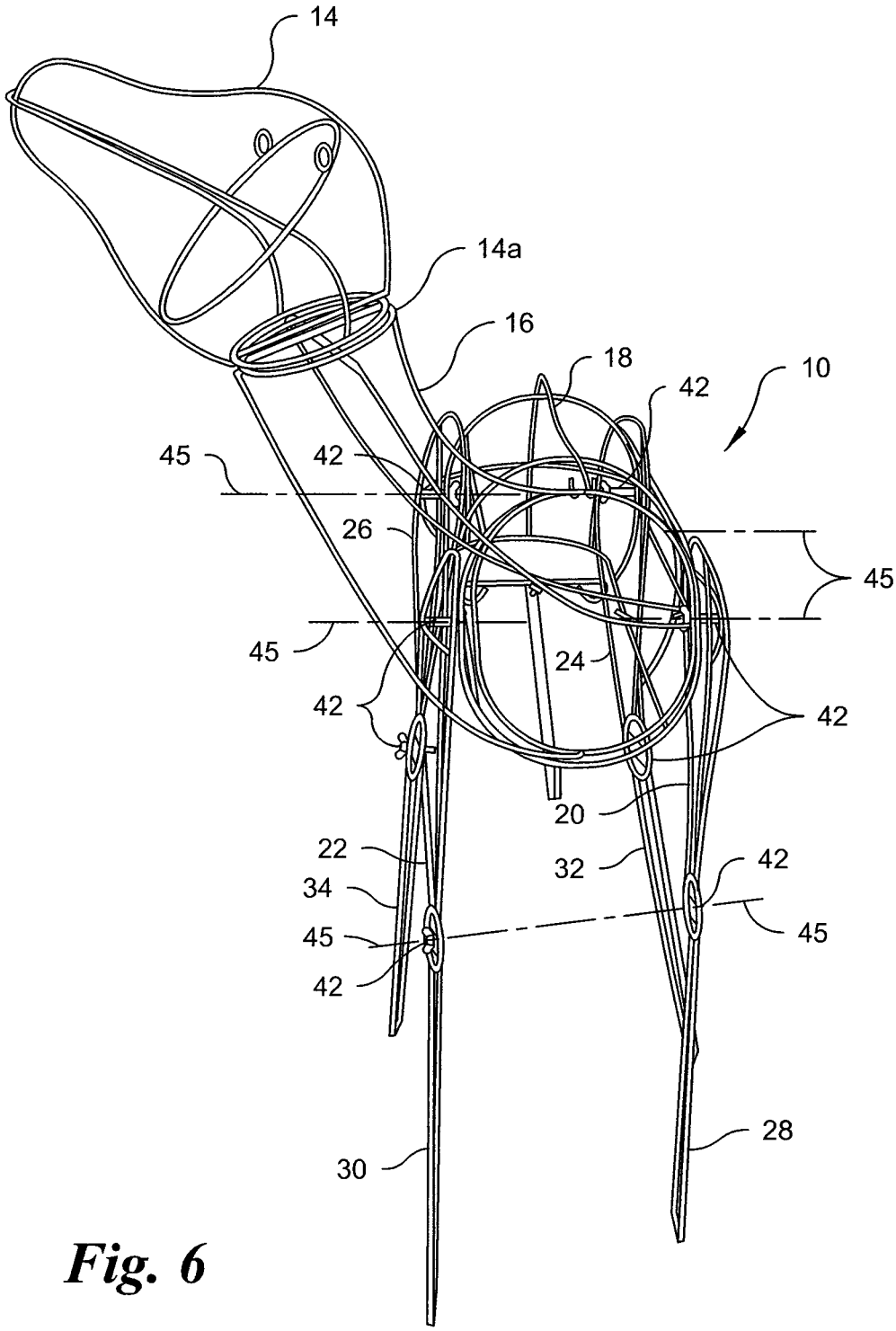
FIG. 6 is an additional alternate front isometric view of the model of FIG. 1, posed in a standing right configuration.
Figure 7:
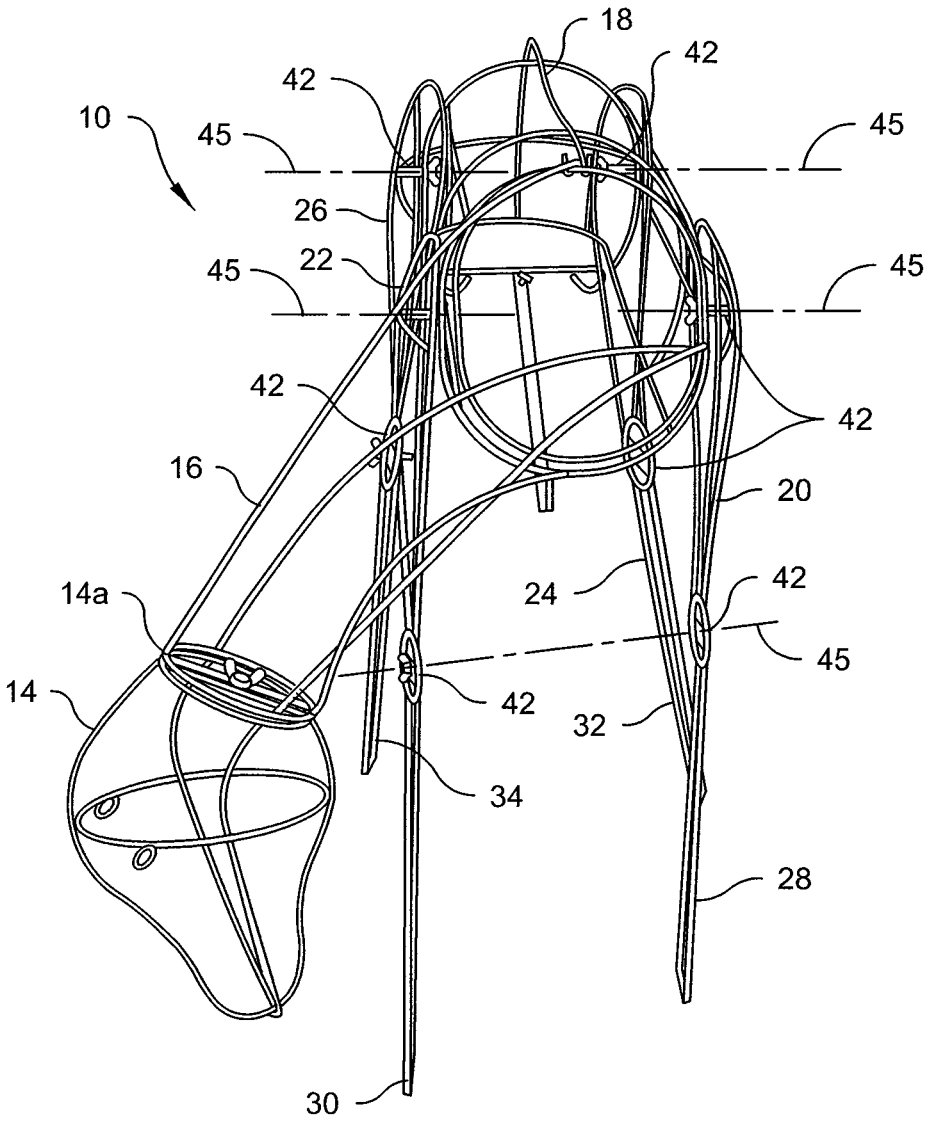
FIG. 7 is a further alternate front isometric view of the model of FIG. 1, posed in a standing, feeding right configuration.

The head 14 is preferably mountable to the neck 16 in at least three different orientations including a center configuration (FIG. 2), a left-facing orientation (FIG. 5) and a right-facing orientation (FIG. 6), and preferably with a pivot joint for any degree of rotation of the head 14 with respect to the neck 16. The neck 16 is also preferably mountable to the body 18 in left and right orientations (FIGS. 5 and 6, respectively). Utilizing these various mountings of the neck 16 to the body 18 and the head 14 to the neck 16, the deer model 10 can be posed to various positions including feeding center (FIG. 3), feeding left (FIG. 4), feeding right (FIG. 7), standing center (FIG. 2), standing left (FIG. 5) and standing right (FIG. 6). The preferred deer model 10 is not limited to these specific positions and the head 14, neck 16 and body 18 may be adapted to promote additional positions and orientations, as would be apparent to one having ordinary skill in the art and to potential end users based upon a review of the present application.

The head 14, neck 16 and body 18 may include indices or other visual indications to the user regarding where to align the neck 16 relative to the body 18 and the head 14 relative to the neck 16 to pose the deer model 10 in each of the above-described orientations. For example, the body 18 may include color coding at its attachment to the neck 16 that may be aligned with color coding on the neck 16 to position the deer model 10 in the described positions. Accordingly, for example, if a red indicator on the neck 16 is aligned with a red indicator on the body 18 and a red indicator on the head 14 is aligned with a red indicator at its attachment with the neck 16, the deer model 10 may be positioned in the center feeding position and if a yellow indicator on the neck 16 is aligned with a yellow indicator on the body 18 and a yellow indicator on the head 14 is aligned with a yellow indicator on the neck 16, the deer model 10 may be arranged in the standing left position. These indications would serve the purpose of guiding the end user to popular positions, but the end user may also choose any position in a three hundred sixty degree (360°) circle to position one of the head 14, neck 16 and body 18 relative to each other, as desired, and the model 10 is not limited to including any such indications.

In the preferred embodiment, the head 14 may be attached to the neck 16 and the neck 16 may be attached to the body 18 in any manner including fastening, clamping, rotatable joints, hook and loop material, wing nuts and bolts, ties or nearly any attachment mechanism that permits the head 14, neck 16 and body 18 to be manipulated relative to each other to the various desirable positions described above. Attachments might be on the outside of the legs or other appendages like the preferred embodiment or on the inside, top, bottom, etc. of the adjoining appendages. Further, it is preferable for the head 14 to be removable from the neck 16 and the neck 16 to be removable from the body 18, but this feature is not required. For example, the head 14 may be assembled to the neck 16 and the neck 16 may be assembled to the body 18 such that the neck 16 is reconfigurable, such as removable and replaceable in a different configuration, pose or orientation or pivotable relative to the body 18 and the head 14 is preferably pivotable relative to the neck 16 to position the deer model 10 in the above-described orientations. In addition, the head 14 and neck 16 may not be mounted to the respective components such that they are pivotable an unlimited amount, but may be limited in their rotational movement relative to each other to accommodate the desired orientations of the head 14 relative to the neck 16 and the neck 16 relative to the body 18.

Moreover, while the various specific embodiments of the invention are described with respect to static structures, the adaptable three-dimensional ornamental wire frame models of the present invention could be motorized, or driven by wind, weights or magnets to move various appendages and provide an animated appearance to the model as is well-known in this art. However, with the various pivot joints and other moveable joints of the present invention, more aspects of the model 10 could be animated than presently available models.

The preferred ears 38 and antlers 40 are removably mountable to the head 14 to modify the deer model 10 to be interchangeable from a doe to a buck. In addition, different sizes and varieties of antlers or ornamental components may be removably mounted to the head 14. For example, if the model 10 is configured as a snowman, various arms, appendages, hats, noses or other related decorative components (not shown) may be removably mountable to the head 14, neck 16 and/or body 18 to provide various ornamental features to the snowman. The same configuration may be utilized for the tail 36 and the tail 36 may also be mountable in various orientations relative to the body 18, similar to the head 14 and neck 16, such as straight up or straight down.

The upper leg portions 20, 22, 24, 26 are preferably pivotally mounted to the body 18 with a first embodiment of a pivot joint 42 or a second embodiment of a pivot joint 54 and the lower leg portions 28, 30, 32, 34 are preferably mounted to the upper leg portions 20, 22, 24, 26 by the pivot joints 42 or 54. The pivot joints 42 or 54 are preferably positioned at the anatomical positions of bending joints in the anatomical structure of the model 10. In the preferred deer model 10 the pivot joints 42 and 54 are preferably positioned at the hips and knees of the deer. The pivot joints 42 and 54 preferably provide pivoting of the components relative to each other in a relatively close to anatomical manner such that the model 10 may be posed in various and multiple life-like poses and the user may readily adapt and modify the poses based upon an overall theme of their display with ease. However, the pivot joints 42 and 54 are not limited to configurations that provide life-like or anatomical poses and may be arranged and adapted such that various fanciful, whimsical, spectacular or bizarre poses of the model 10 are possible. For example, if the model 10 is configured as a snowman or other imaginary caricature, the head 14, body 18 and related components and appendages may be adaptable with various joints to provide various fanciful and/or bizarre poses. The pivot joints 42 of the preferred embodiment permit three hundred sixty degrees) (360°) of pivoting or unlimited pivoting at the joint for posing and/or storage purposes. For example, the upper and lower leg portions 20, 22, 24, 26, 28, 30, 32, 34 ("20-34") may be pivoted into nearly any anatomical orientation relative to each other or the body 18 for position purposes and may also be pivoted to positions that are generally non-anatomical where the size of the model 10 is minimized for storage purposes, as would be apparent to one having ordinary skill in the art based upon a review of the present disclosure.

The pivot joints 42 preferably pivot, bend, rotate or otherwise move in a generally anatomical manner. In the preferred deer model 10, the pivot joints 42 at the hips and knees generally pivot about a pivot axis 45, that is generally perpendicular to a longitudinal axis 18*a* of the body 18. The generally anatomical movement of the pivot joints 42 permits the user to pose the model 10 in anatomically correct poses. Accordingly, the pivot joints 42 of the preferred embodiment are not limited to only pivoting about the pivot axis 45 and may rotate or otherwise articulate such that the leg portions 20-34 are able to move in an anatomical manner or in various non-anatomical, fanciful directions and orientations. In addition, the pivot joints 42 are preferably adapted to pivot or otherwise move in a manner that at least generally depicts the anatomical movements of the modeled animal, individual or object. For example, joints of an angel model (not shown) may include pivot joints at the base of wings that pivot generally parallel to a longitudinal axis of the angel's body.

The head joint 14*a* of the preferred embodiment is comprised of the preferred pivot joint 42 that pivotably mounts the head 14 to the neck 16 and provides three hundred sixty degrees) (360°) of pivoting of the head 14 relative to the neck 16. The head joint 14*a* is not limited to being comprised of the pivot joint 42 and may be comprised of nearly any joint that permits engagement of the head 14 to the neck 16, such as integrally forming the head 14 with the neck 16, removably mounting the head 14 to the neck 16 or otherwise mounting the head 14 to the neck 16.

Figure 8:
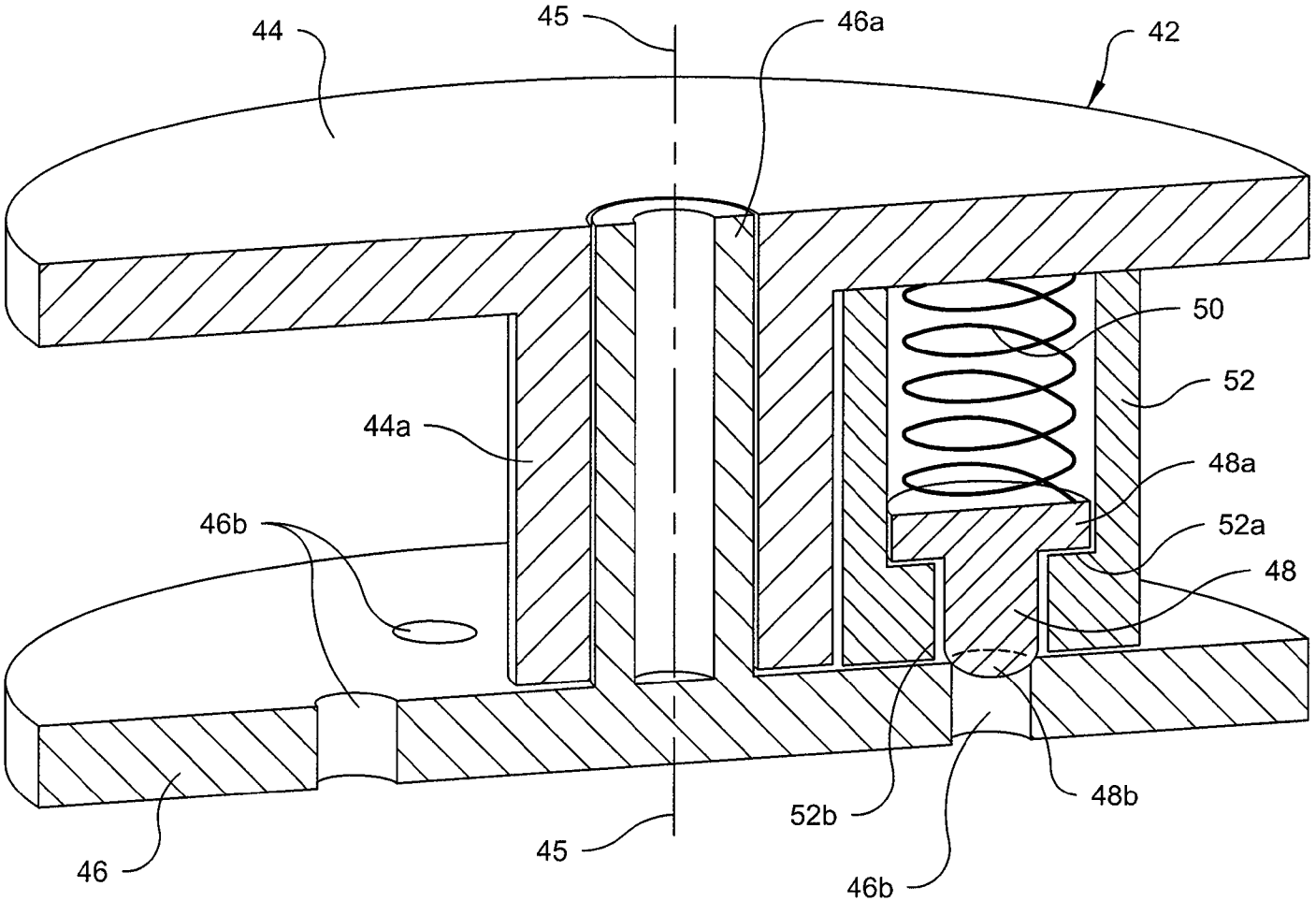
FIG. 8 is a cross-sectional view of a first embodiment of a pivot joint that may be used with the model of FIG. 1.
Figure 9:
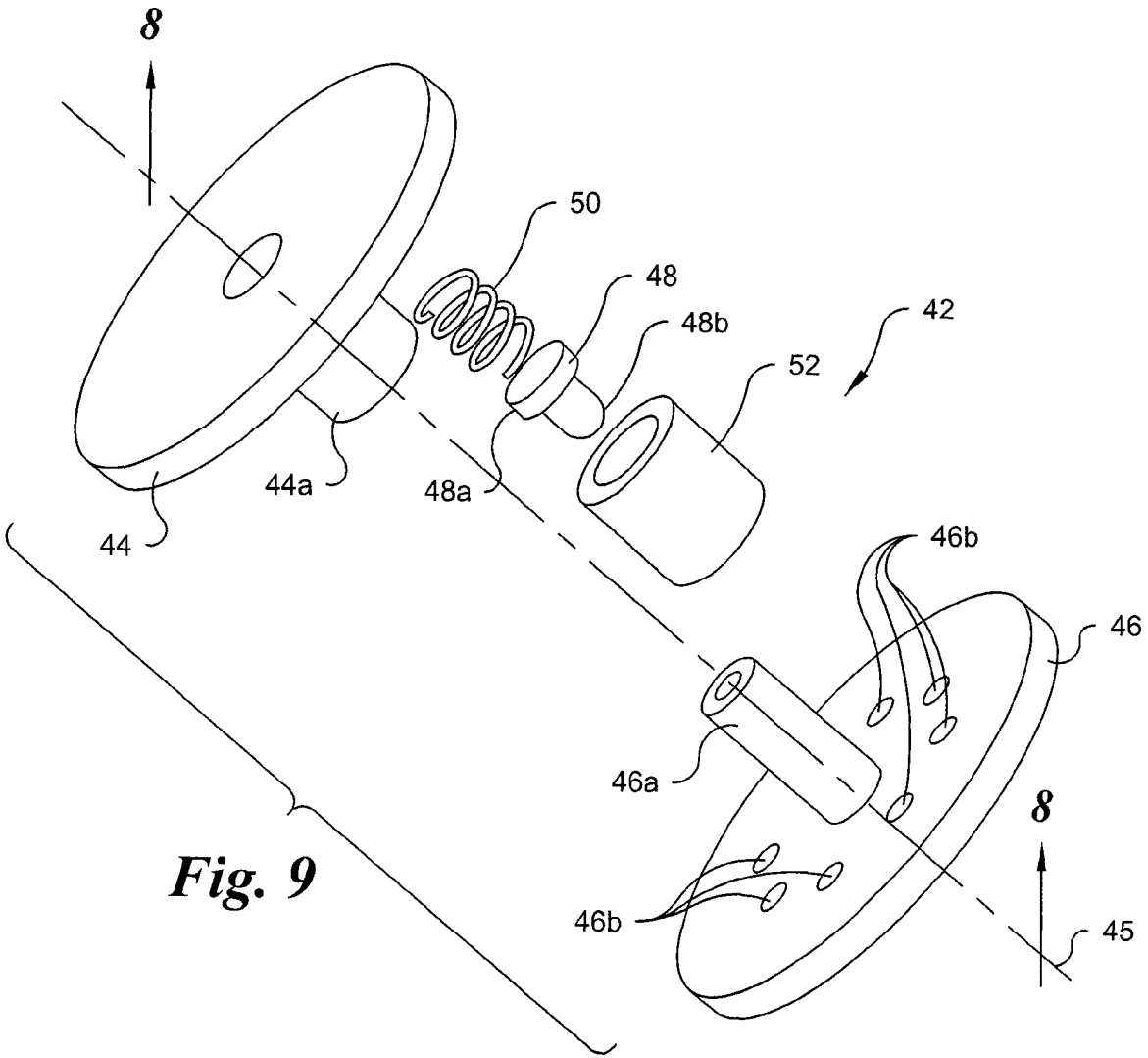
FIG. 9 is a side isometric, exploded view of the first embodiment of the pivot joint of FIG. 8.
Figure 15:
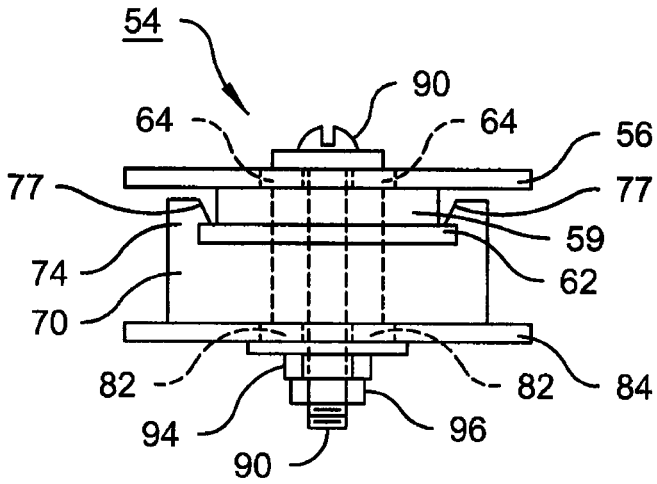
FIG. 15 is a side elevation view of a second embodiment of a pivot joint that may be used with the model of FIG. 1.
Figure 17:
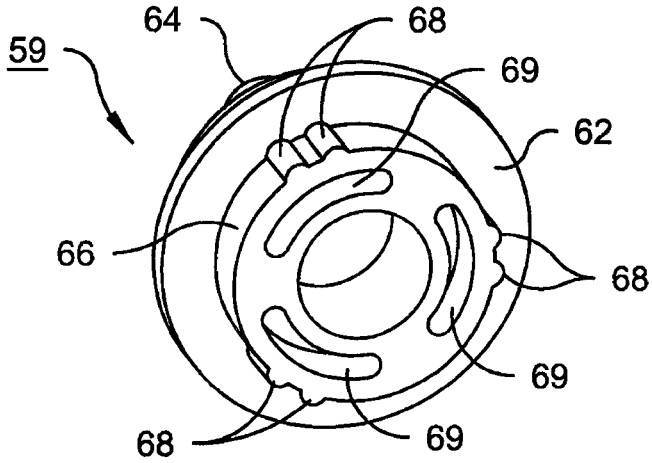
FIG. 17 is a bottom isometric view of a first click lock member component of the second embodiment of a pivot joint of FIG. 15.
Figure 16:
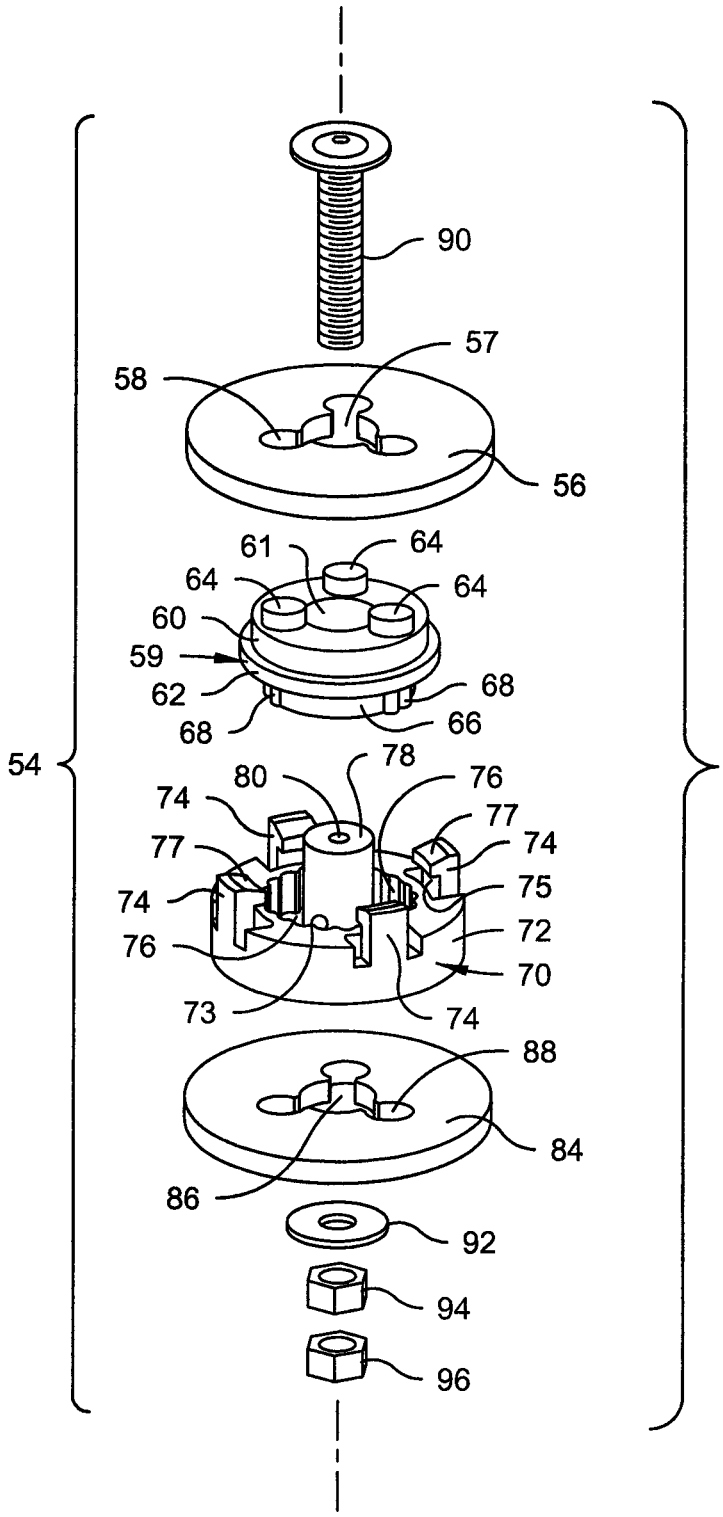
FIG. 16 is an exploded view of the second embodiment of a pivot joint of FIG. 15.

The neck joint 16*a* of the preferred embodiment is comprised of a joint that permits pivoting of the neck 16 relative to the body 18 about a generally vertical axis that is perpendicular relative to the longitudinal axis 18*a* such that the neck 16 may be pivoted in a generally side-to-side manner relative to the body 18 to accommodate the above-described left-facing and right-facing orientations. In addition, the neck joint 16*a* of the preferred embodiment permits pivoting of the neck 16 relative to the body 18, generally about the longitudinal axis 18*a* to accommodate the above-described feeding and standing orientations. However, the neck joint 16*a* is not limited to having the above-described features, and may be comprised of nearly any joint that secures the neck 16 to the body 18, such as a fixed joint, an unlimited pivoting joint, the preferred pivot joints 42 (details of which are shown in FIGS. 8 and 9) or pivot joints 54 that may be substituted for the pivot joints 42 (where the details of the pivot joints 54 are shown in FIGS. 15-17), a removable clamping joint or nearly any related appropriate joint.

The pivot joints 42 or 54 may also be arranged and configured on the body 18 and leg portions 20-34 such that the model 10 and its components are readily foldable into a storage or shipping configuration to take up as little space as possible and to generally protect the model 10 during shipping and in storage by consolidating the parts.

Figure 10:
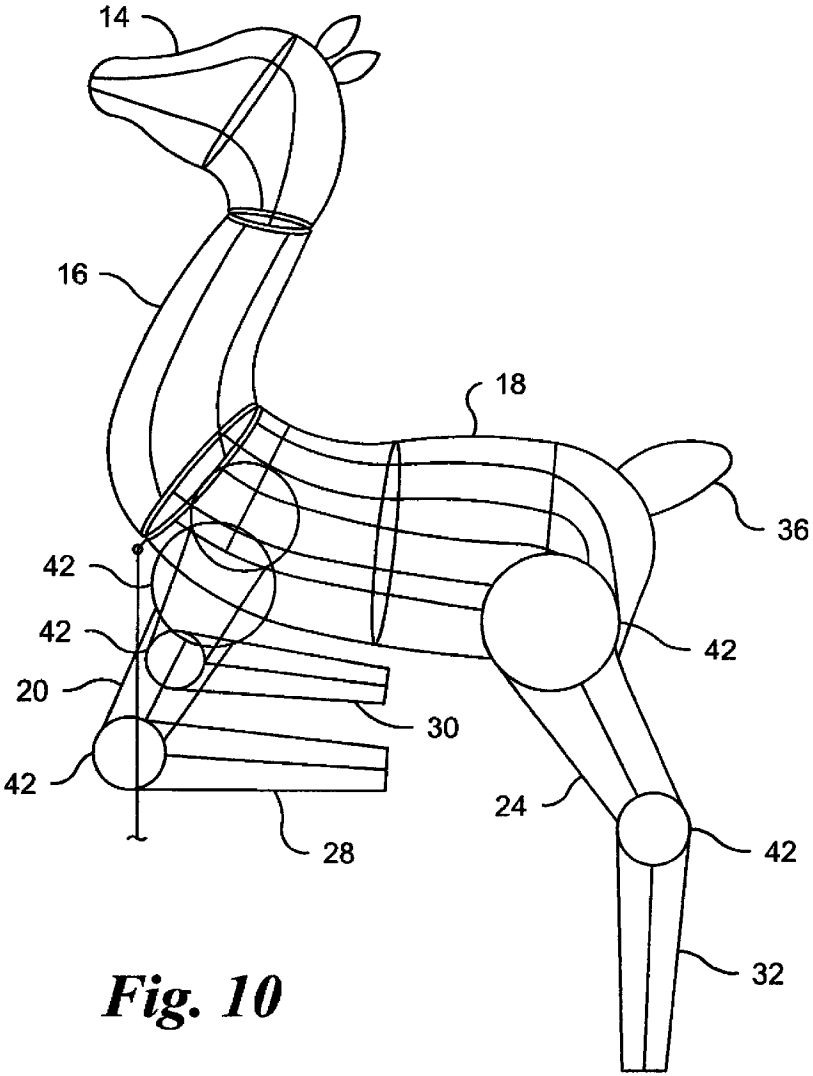
FIG. 10 is a side isometric view of the model of FIG. 1, posed in a jumping center configuration with portions of the wire frame highlighted for clarity.
Figure 11:
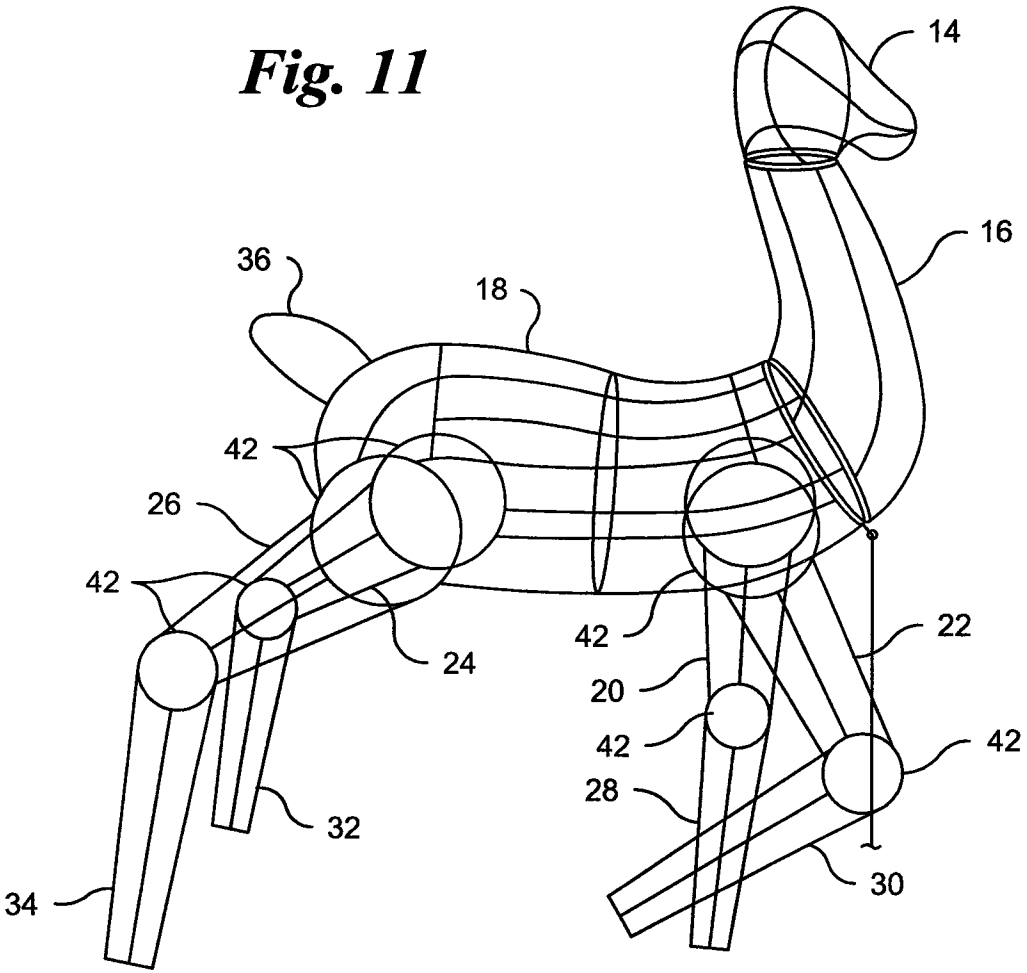
FIG. 11 is a side isometric view of the model of FIG. 1, posed in a right leg up center configuration with portions of the wire frame highlighted for clarity.
Figure 12:
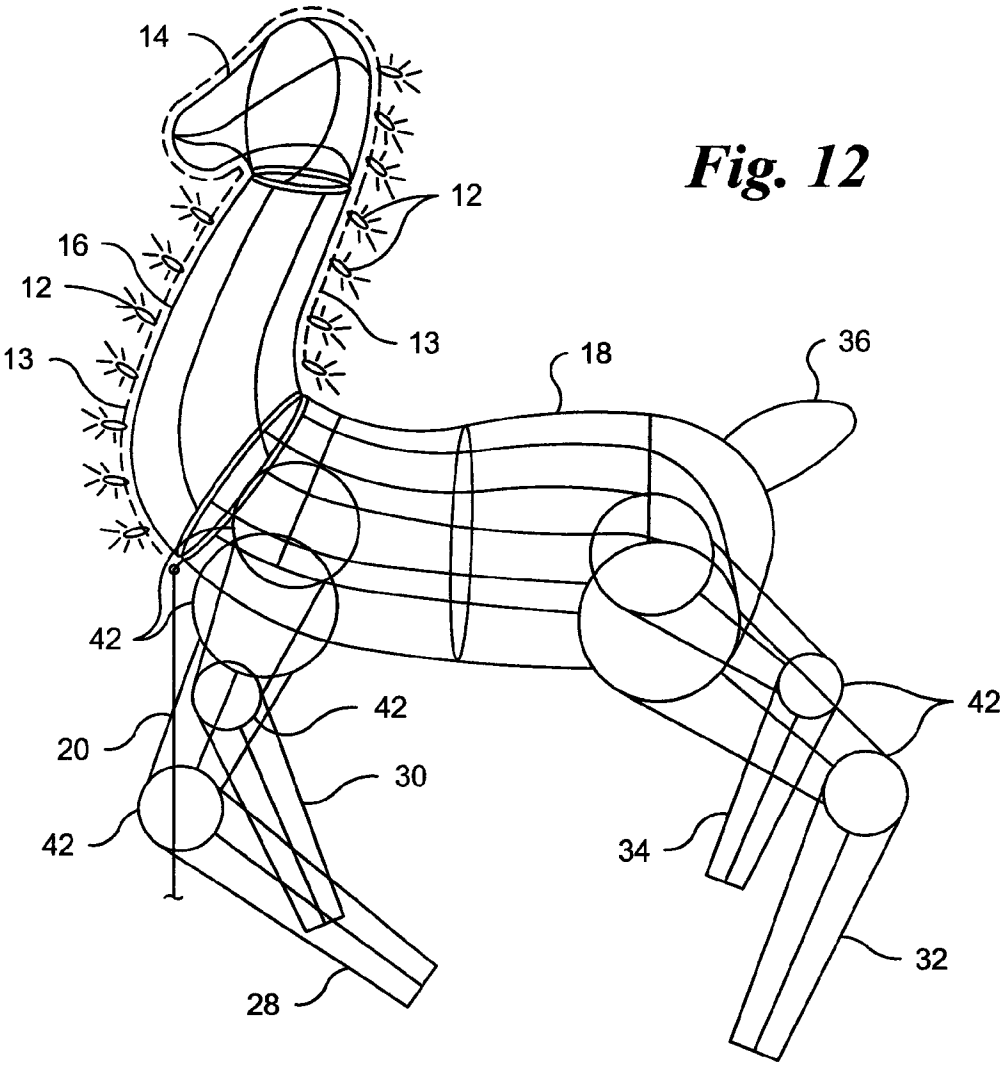
FIG. 12 is a side isometric view of the model of FIG. 1, posed in a left leg up left configuration with portions of the wire frame highlighted for clarity.
Figure 13:
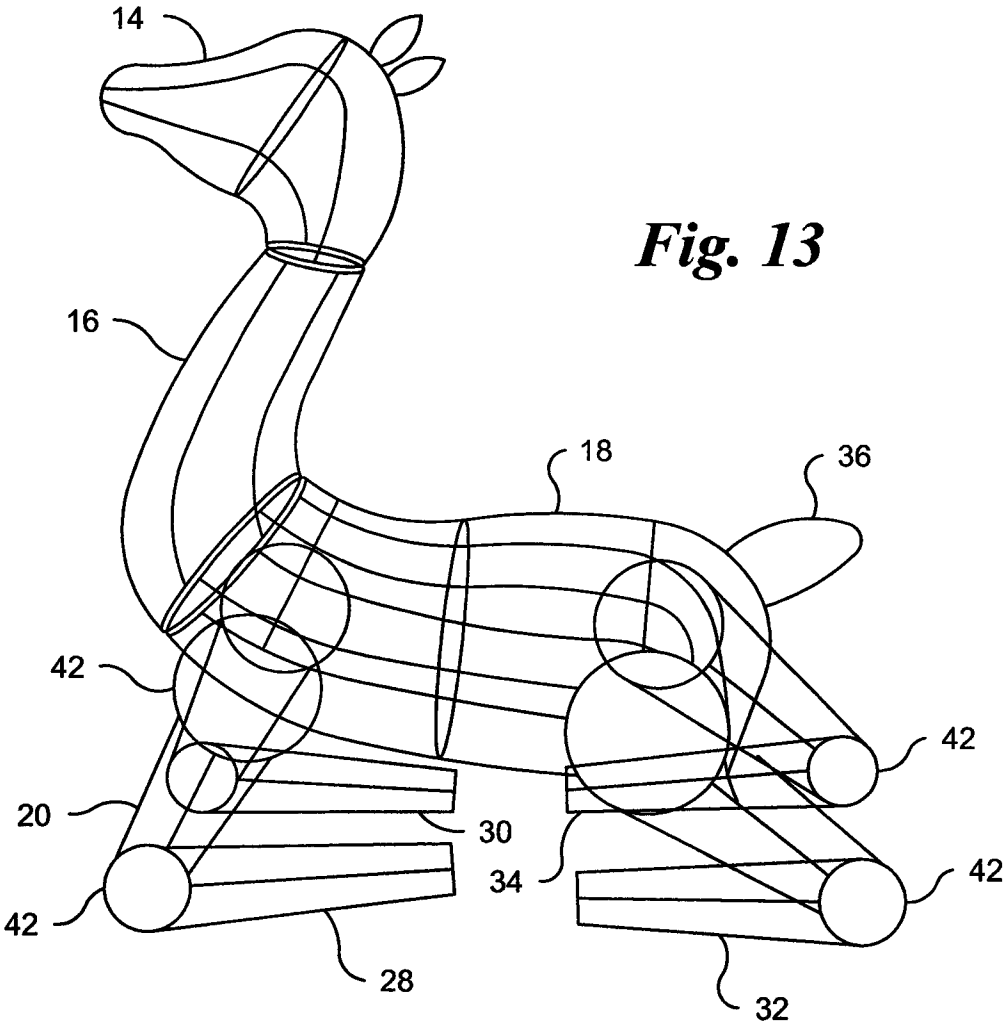
FIG. 13 is a side isometric view of the model of FIG. 1, posed in a laying center configuration with portions of the wire frame highlighted for clarity.
Figure 14:
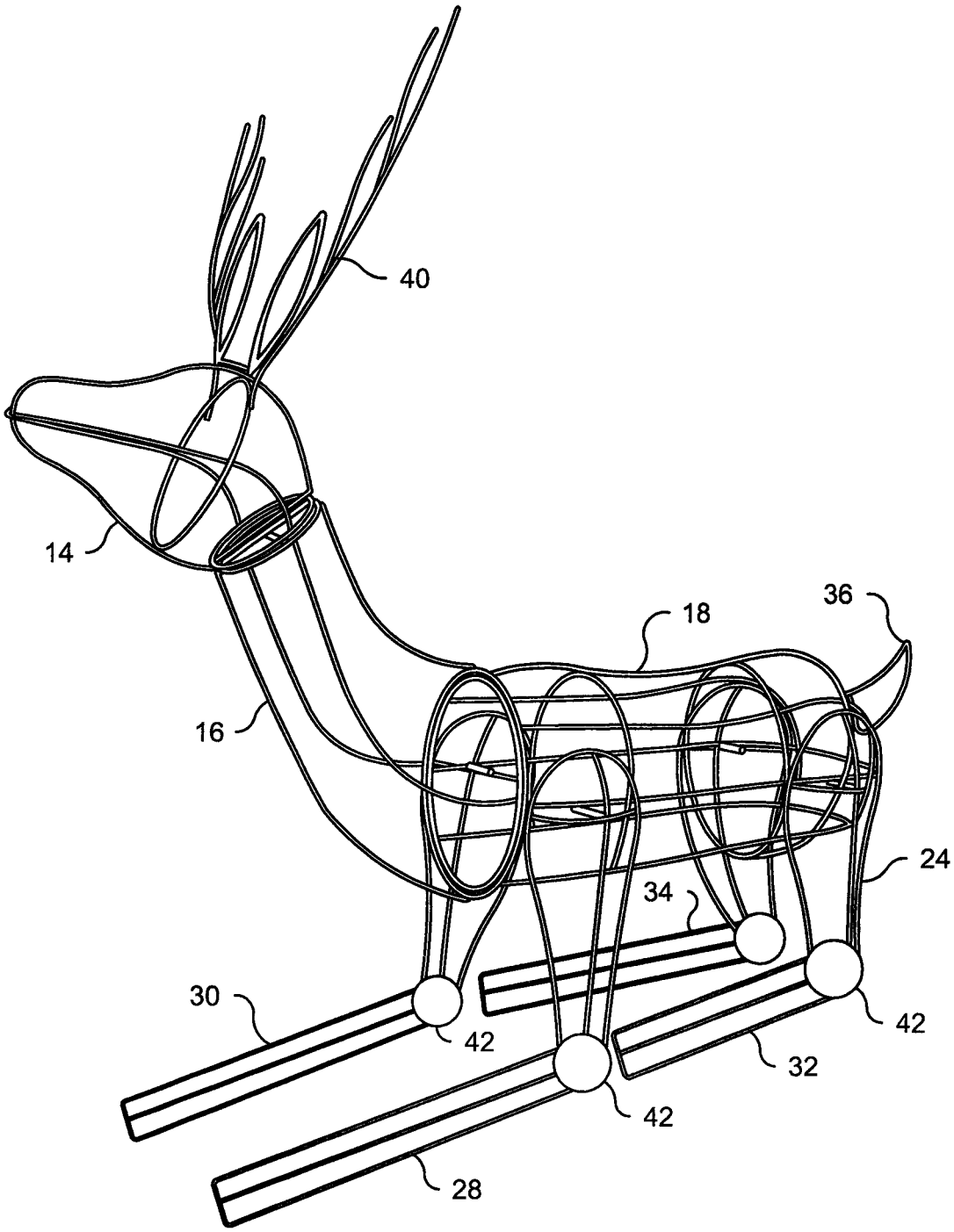
FIG. 14 is a side isometric view of the model of FIG. 1, posed in a laying center configuration with antlers mounted to a head.

The leg portions 20-34 are preferably configurable such that the deer model 10 may be posed in at least a standing position (FIGS. 1-7), a laying position (FIGS. 13 and 14) wherein the leg portions 20-34 are consolidated or pivoted to positions close to the body 18, a jumping position (FIG. 10) wherein the rear leg portions 24, 26, 32, 34 are orientated generally normally and the front leg portions 20, 22, 28, 30 are in a raised position, which may be fully extended generally parallel to the longitudinal axis 18*a* of the body 18 or at least the upper front leg portions 20, 22 oriented generally parallel to the longitude axis of the body 18, a right leg up position (FIG. 11) wherein the right front leg portions 22, 30, are raised from the ground, a left leg up position (FIG. 12) wherein the front left leg portions 20, 28, are raised from the ground, a flying position (not shown) wherein the front leg portions 20, 22, 28, 30 are pivoted forwardly and oriented generally parallel to the longitudinal axis 18*a* of the body 18 and the rear leg portions 24, 26, 32, 34 are pivoted rearwardly and generally parallel to the longitudinal axis 18*a* of the body 18 or numerous additional positions and orientations of the leg portions 20-34 relative to the body 18. The pivot joints 42 preferably allow the user to pose the model 10 in nearly an unlimited number of poses as is desirable to a user to depict different positions of the model 10. Such pivoting at the pivot joints 42 provides adaptability to the model 10 for posing in the user-desired positions such that any individual model 10 may be posed in the user-desired position, thereby overcoming the single pose of the above-described fixed position models. Accordingly, the model 10 of the present invention permits a user to purchase a single model 10 for adaptable positioning in several desired configurations, as opposed to purchasing numerous fixed position models of the prior art to obtain a model that has the desired positioning.

When the model 10 is in the form representing a deer, the model is adaptable to be posed, configured or oriented in at least the following specific orientations: standing with neck up and head facing right; standing with neck up and head facing center, standing with neck up and head facing left; feeding with neck down and head facing right, feeding with neck down and head facing center, feeding with neck down and head facing left; jumping with two front legs pivoted with respect to the body and upper and lower appendages and with the neck up and head facing right, jumping with two front legs pivoted with respect to the body and upper and lower appendages and with the neck up and head facing center, jumping with two front legs pivoted with respect to the body and upper and lower appendages and with the neck up and head facing left; jumping with two front legs pivoted with respect to the body and upper and lower appendages and with the neck down and head facing right, jumping with two front legs pivoted with respect to the body and upper and lower appendages and with the neck down and head facing center, jumping with two front legs pivoted with respect to the body and upper and lower appendages and with the neck down and head facing left; laying with all legs pivoted with respect to the body and the upper and lower appendages such that the legs are representing being fully folded next to the body and with the neck up and head facing right, laying with all legs pivoted with respect to the body and the upper and lower appendages such that the legs are representing being fully folded next to the body and with the neck up and head facing center, laying with all legs pivoted with respect to the body and the upper and lower appendages such that the legs are representing being fully folded next to the body and with the neck up and head facing left, laying with all legs pivoted with respect to the body and the upper and lower appendages such that the legs are representing being fully folded next to the body and with the neck down and head facing right, laying with all legs pivoted with respect to the body and the upper and lower appendages such that the legs are representing being fully folded next to the body and with the neck down and head facing left; standing with one leg up such that the lower appendage of the lower leg portion is bent toward the body and with the neck up and head facing right, standing with one leg up such that the lower appendage of the lower leg portion is bent toward the body and with the neck up and head facing center, standing with one leg up such that the lower appendage of the lower leg portion is bent toward the body and with the neck up and head facing left, and standing with one leg up such that the lower appendage of the lower leg portion is bent toward the body and with the neck down and head facing right, standing with one leg up such that the lower appendage of the lower leg portion is bent toward the body and with the neck down and head facing center, standing with one leg up such that the lower appendage of the lower leg portion is bent toward the body and with the neck down and head facing left.

Referring to FIGS. 8 and 9, in one preferred embodiment, the pivot joint 42 includes a first mount 44, a second mount 46, a pin 48, a spring 50 and a spring housing 52. The first mount 44 preferably includes a first hollow shaft 44*a* and the second mount 46 preferably includes a second hollow shaft 46*a* that is pivotably received within the first shaft 44*a*. The first mount 44 is preferably secured to one of the components or appendages and the second mount 46 is preferably mounted to an adjacent component or appendage to permit pivoting of the components or appendages relative to each other. The first and second mounts 44, 46 are pivotable relative to each other about a pivot axis 45. The first and second mounts 44, 46 may be secured together by a fastener with a head (not shown) secured in the hollow of the second shaft 46*a*, the second shaft 46*a* may be deformed at its distal end to secure the first mount 44 thereto, a cap (not shown) may be secured to the distal end of the second shaft 46*a* to secure the first mount 44 to the second mount 46 or the first mount 44 may be otherwise secured to the second mount 46 by a bearing or other mechanisms that permit pivoting of the first mount 44 relative to the second mount 46. The first and second mounts 44, 46 of the preferred embodiment are pivotable three hundred sixty degrees (360°) relative to each other, but are not so limited and may be limited in their pivotability relative to each other to limit the anatomical positioning of the components or appendages relative to each other.

The spring housing 52 is preferably secured to the first mount 44 adjacent the first shaft 44*a* and is sandwiched between the first mount 44 and the second mount 46 in an assembled configuration. The spring housing 52 includes a central bore with a ledge 52*a* between two diameters of the bore and a distal opening 52*b* that is positioned adjacent the second mount 46 in the assembled configuration. When the first mount 44 pivots relative to the second mount 46, the spring housing 52 preferably pivots with the first mount 44. The pin 48 and the spring 50 are mounted within the central bore such that the spring 50 contacts the first mount 44 and a rib 48*a* of the pin 48 is in selective contact with the ledge 52*a*. The pin 48 also includes a nose 48*b* that extends out of the distal opening 52*b* of the spring housing 52 in an extended position. The second mount 46 preferably includes several holes 46*b* radially spaced about the second shaft 46*a* at generally the same radius as the distal opening 52*b* of the spring housing 52 in the assembled configuration. In an extended position, the pin 48 extends out of the distal opening 52*b* and into one of the holes 46*b* of the second mount 46 to secure the first mount 44 relative to the second mount 46. A user may release the first mount 44 relative to the second mount 46 by applying a pivoting force to the first or second mounts 44, 46 about the pivot axis 45, thereby overcoming the force of the spring 50 and urging the pin 48 toward the first mount and a nose 48*b* of the pin 48 out of the hole 46*b*. The first mount 44 is then pivotable or rotatable relative to the second mount 46, at least until the nose 48*b* drops into another of the holes 46*b*. When the first mount 44 is positioned at a desired orientation relative to the second mount 46, the user locks the orientation of the first mount 44 relative to the second mount 46 by aligning the pin 48 with one of the holes 46*b*. In this locked position, the first mount 44 is generally secured relative to the second mount 46 until a sufficient force is applied to urge the pin 48 out of the hole 46*b*.

For example, the leg portions 20-34 may be manually urged into the various laying, standing, jumping, flying or other orientations by grasping one of the leg portions 20-34 and pivoting the leg portions 20-34 relative to the body 18 or another of the leg portions 20-34. Such a manipulation would cause one of the first or second mounts 40, 46 that is mounted to the manipulated leg portions 20-34 to pivot relative to the adjacent component. When the leg portion 20-34 has the desired orientation relative to another of the leg portions 20-34 or the body 18, the user allows the pin 48 to move into one of the holes 46*b* to secure the orientation of the leg portions 20-34 relative to one of the other leg portions 20-34 or the body 18.

The pivot joint is not limited to having constructions that are the same or similar to the first embodiment of a preferred pivot joint 42 and the joint 42 may be otherwise configured, such as shown by a second preferred embodiment that may be referred to as a click lock pivot joint 54, shown in FIGS. 15-17.

With reference to FIG. 15, a side elevation view, and FIG. 16, an exploded view, the pivot joint 54, may be made of components that do not have a spring that may wear, but instead may be made of components that have sufficient strength and durability and yet have sufficient rigidity on the one hand to be long-lasting and sufficient resiliency and elasticity on the other hand to allow the joint components to move from one pivotable position to another. The pivot joint 54 includes a first mount 56, preferably made of zinc-plated steel or stainless steel for good resistance to outdoor weather, to be attached by welding or any suitable fasteners, such as nuts and bolts for example, to one component, such as a mounting area of a portion of the body 18 at a pivot joint. The first mount 56 has a central aperture 57 and radial apertures 58, preferably, but without limitation, adjacent to the central aperture 57. A first click lock member 59 is a unitary molded component made of a sufficiently durable and rigid yet resilient and elastomeric material providing a low-friction bearing surface, such as a synthetic polymer like polyoxymethylene (POM) such as available as du Pont's Delrin® for example, nylon, polytetrafluoroethylene (PTFE), or the like, that includes a body portion 60 having a central axial aperture 61, an annular flange 62 generally centrally located around the body portion 60, protuberances 64 extending from one flat surface of the body portion 60, and a depending portion 66 including several radially outwardly extending ribs 68, preferably but without limitation arranged in pairs, such as three pairs as shown in the bottom isometric view of FIG. 18, as well as arcuate or curved slots 69 that are only visible in FIG. 18. The protuberances 64 are sized to fit into the radial apertures 58 of the first mount 56 so that the first click lock member 59 rotates along with the first mount 56.

The pivot joint 54 also includes a unitary molded second click lock member 70 also made of a sufficiently durable and rigid yet resilient and elastomeric material, such as POM, nylon, PTFE, or the like, providing a low-friction bearing surface, having a body portion 72. The body portion 72, in the embodiment shown, has four unitarily and integrally formed resilient retainer clips 74, each having a flange 75 and an angled bearing surface 77 for purposes that will be explained below. The body portion 72 also has a central cavity 73 extending from an annular rim to a floor (not shown). The cavity 73 has a radially serrated inner wall 76. The radial serrations of the inner wall 76 preferably match in length and are complementary in shape to the radial ribs 68 on the depending portion 66 of the first click lock member 59. A central axial post 78 having a central axial aperture extends from the floor of the body 72. Underneath the body, as shown in phantom in FIG. 15 protuberances 82 extend from the lower outer surface of the floor in the orientation shown in FIGS. 15 and 16.

A second mount 84 is formed on the opposite end of the pivot joint 54 from the first mount 56. The second mount 84, preferably made of zinc-plated steel or stainless steel for good resistance to outdoor weather, is to be attached by welding or any suitable fasteners, such as nuts and bolts for example, to a relatively rotatable or pivotable component, such as an upper leg portion 20, 22, 24, 26 that rotates or pivots with respect to the one component, such as the mounting area of the portion of the body 18 to which the first mount 56 is attached to form a pivot joint. The second mount 84 has a central aperture 86 and radial apertures 88, preferably, but without limitation, adjacent to the central aperture 86. The protuberances 82 of the second click lock member 70 engage the radial apertures 88 of the second mount 84 so that the second click lock member 70 rotates along with the second mount 84.

A screw or bolt 90 extends through the central aperture 57 of the first mount 56, the central 80 of the central post 78 of the second click lock member 70, and though the central aperture of the second mount 84. The screw or bolt 90 is secured by a washer 92, a nut 94 and a lock nut 96, for example, although other ways to secure the screw or bolt could also readily be used, such as by a C-clip friction fitting into an annular groove near the end of the screw or bolt opposite the head of the screw or bolt 90, or a cotter pin fitting into a transverse hole near the end of the screw or bolt opposite the head of the screw or bolt 90. Preferably, to withstand outdoor weather conditions, the screw or bolt 90 and its washer 92 and nuts 94 and 96 or other fittings and securements are preferably also made of zinc-plated steel or stainless steel.

When the pivot joint 54 is assembled as shown in FIG. 15, the central post 78 of the second click lock member extends axially into the central axial aperture 61 of the first click lock member 59. As the nut 94 is tightened on the screw of bolt 90, the angled bearing surfaces 77 of the retainer clips 74 of the second click lock member 70 bear against the outer edge of the annular flange 62 of the first click lock member 59, thus radially spreading the retainer clips 74. As the nut 94 is tightened further on the screw or bolt 90, the retainer clips 74 return to their radially inward position and the flanges 75 of the retainer clips 74 of the second click lock member 70 engage the upper surface of the annular flange 62 of the first click lock member 59. The depending portion 66 of the first click lock member 59 is then held within the cavity 73 of the second click lock member 70 such that the pairs of radial ribs 68 are in frictional engagement with the complementary shaped radially serrated inner wall 76.

In operation, the pivot joint 54 holds the relatively rotatable or pivotable components in the desired location by the friction force between the radial ribs 68 of the first click lock member and the radially serrated inner wall 76 of the second click lock member. When a user desires to change the position of the relatively rotatable components, say an upper leg portion 20 and the body 18, for example, the user rotates the upper leg portion attached to, say, the second mount 84 of the second click lock member 70. The arcuate or curved slots 69 spaced and located adjacent the ribs 68 allow the aligned depending portion of the first click lock member 59 to flex radially inward sufficient to allow the ribs to overcome the friction force against the radially serrated inner wall 76 to allow the leg portion 20 to be rotated or pivoted with respect to the first click lock member 59 attached via the first mount 56 to the body until the desired position is reached where the ribs 68 again frictionally bear against the radially serrated inner wall 76 to retain the wire structure components in the desired configuration, pose or orientation.

Other examples of pivot joints that could substitute for the pivot joint 42 or pivot joint 54 may have nearly any construction that permits mounting of the leg portions 20-34 to the body 18 and to each other and the head 14 and neck 16 to each other while allowing pivoting in a relatively anatomical manner relative to each other. The pivot joints may be comprised of bearings, pivotable locks, clamps, spring loaded attachment mechanisms, fasteners, such as wing nuts and bolts or screws attached to plates, or any other mechanism that permits the above-described pivoting movement of the leg portions 20-34 relative to the body 18 and to each other and the pivotable movement of the head 14 and neck 16 relative to each other. Thus, although the preferred embodiments use the pivot joints 42, or more preferably pivot joints 54, for relative rotational or pivoting motion, but as noted above, any type of connection, no matter how simple or of any construction, between the appendages that allows a user to readily change the pose, configuration or orientation of the components, are still within the scope of the present invention.

Referring to FIGS. 1-17, in use, the head 14, neck 16, ears 38, antlers 40, and potentially additional of the above-described components may be removed from the body 18 and each other or preferably pivoted to fold. The overall structure may be and preferably is consolidated to as small a volume as possible, for shipping and/or storage. The model 10 is removed from shipping or storage and is assembled or unfolded, generally as shown in FIGS. 1-7. The user is then able to pose the model 10 in nearly any imaginable pose by manipulating the pivotable joints 42 or 54, the head 14, neck 16, ears 38, antlers 40 and any additional components that are included in a kit. The ears 38, antlers 40 and/or tail 36 or other components are attached to the model 10 to further adapt the ornamental appearance of the model 10. The model 10 is then displayed and the lights 12 may be turned on to further enhance the outline of the model 10.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as is described in the present application.

I claim:

1. An adaptable three-dimensional ornamental wire frame model for display by a user in various poses or configurations, the model comprising components including:

a body;

a neck having a body end and a head end, the neck being mountable to the body at the body end of the neck;

a head removably mounted to the head end of the neck and the neck being removably mounted to the body at the body end; and an appendage mounted to the body;

wherein the appendage is reconfigurable to a different pose or configuration by the user, the appendage pivotable relative to the body through a pivot joint secured to the body and the appendage, the pivot joint including a first mount and a second mount that is pivotable relative to the first mount, the pivot joint further including a pin selectively mountable in holes in the second mount to selectively lock the position of the first mount relative to the second mount.

2. The adaptable model of claim 1, wherein the appendage includes an upper appendage and a lower appendage.

3. The adaptable model of claim 2, wherein the lower appendage is pivotably mounted to the upper appendage by a pivot joint.

4. The adaptable model of claim 2, wherein at least two of the head, the neck and the appendage are reconfigurable to a different pose or configuration by the user.

5. The adaptable model of claim 4, wherein at least three of the head, the neck and the appendage are reconfigurable to a different pose or configuration by the user.

6. The adaptable model of claim 1, wherein the appendage includes an upper appendage and a lower appendage, and wherein all of the head, the neck, the upper appendage and the lower appendage are reconfigurable to a different pose or configuration by the user.

7. The adaptable model of claim 1, wherein the head is pivotably mounted to the neck by a pivot joint.

8. The adaptable model of claim 1, wherein the neck is mounted to the body by a neck joint that is reconfigurable with respect to the body, the head is mounted to the head end of the neck at a head joint that is movable with respect to the neck, the appendage includes an upper appendage pivotably mounted to the body by a first pivot joint and a lower appendage pivotably mounted to the upper appendage by a second pivot joint, the first and second pivot joints including first and second mounts that are pivotable relative to each other, the neck and head joints and the first and second pivot joints permitting the user to display the model in various poses and configurations as desired by the user.

9. The adaptable model of claim 1, further comprising decorative lights mounted on the model.

10. The adaptable model of claim 9, wherein the lights are present along a light string that is mounted to the model.

11. The adaptable model of claim 10, wherein the light string is mounted with slack in at least some areas where the components are movable or pivotable with respect to each other so that the light string does not adversely affect the ability of the components in the area of the slack light string to be movable with respect to each other.

12. The adaptable model of claim 11, wherein the light string is mounted with slack where the neck joins the body and the head joins the neck so that the light string does not adversely affect the ability of the neck to be movable with respect to the body and the ability of the head to be movable with respect to the neck.

13. The adaptable model of claim 1, wherein the wire frame is metal.

14. The adaptable model of claim 1, wherein the model has a decorative covering.

15. The adaptable model of claim 1, wherein the model, once fixed in a desired position by a user, is static.

16. The adaptable model of claim 1, wherein the model is animated.

17. The adaptable model of claim 1, wherein the model represents a deer having four legs each comprising an upper appendage representing an upper leg portion and a lower appendage representing a lower leg portion.

18. The adaptable model of claim 17, wherein the deer is interchangeable as a buck with additional removable antler components or as a doe without additional removable ear components.

19. The adaptable model of claim 17, wherein the adaptable model is adaptable to be configured in at least the following orientations: standing with neck up and head facing right; standing with neck up and head facing center, standing with neck up and head facing left; feeding with neck down and head facing right, feeding with neck down and head facing center, feeding with neck down and head facing left; jumping with two front legs pivoted with respect to the body and upper and lower appendages and with the neck up and head facing right, jumping with two front legs pivoted with respect to the body and upper and lower appendages and with the neck up and head facing center, jumping with two front legs pivoted with respect to the body and upper and lower appendages and with the neck up and head facing left; jumping with two front legs pivoted with respect to the body and upper and lower appendages and with the neck down and head facing right, jumping with two front legs pivoted with respect to the body and upper and lower appendages and with the neck down and head facing center, jumping with two front legs pivoted with respect to the body and upper and lower appendages and with the neck down and head facing left; laying with all legs pivoted with respect to the body and the upper and lower appendages such that the legs are representing being fully folded next to the body and with the neck up and head facing right, laying with all legs pivoted with respect to the body and the upper and lower appendages such that the legs are representing being fully folded next to the body and with the neck up and head facing center, laying with all legs pivoted with respect to the body and the upper and lower appendages such that the legs are representing being fully folded next to the body and with the neck up and head facing left, laying with all legs pivoted with respect to the body and the upper and lower appendages such that the legs are representing being fully folded next to the body and with the neck down and head facing right, laying with all legs pivoted with respect to the body and the upper and lower appendages such that the legs are representing being fully folded next to the body and with the neck down and head facing left; standing with one leg up such that the lower appendage of the lower leg portion is bent toward the body and with the neck up and head facing right, standing with one leg up such that the lower appendage of the lower leg portion is bent toward the body and with the neck up and head facing center, standing with one leg up such that the lower appendage of the lower leg portion is bent toward the body and with the neck up and head facing left, and standing with one leg up such that the lower appendage of the lower leg portion is bent toward the body and with the neck down and head facing right, standing with one leg up such that the lower appendage of the lower leg portion is bent toward the body and with the neck down and head facing center, standing with one leg up such that the lower appendage of the lower leg portion is bent toward the body and with the neck down and head facing left.

20. The adaptable model of claim 19, further comprising decorative lights mounted on the model.

* * * * *